US006223993B1

(12) United States Patent
Lawrence

(10) Patent No.: US 6,223,993 B1
(45) Date of Patent: May 1, 2001

(54) CLIMATE CONTROL DEVICE

(76) Inventor: Walter C. Lawrence, 1358 E. 51st No., Tulsa, OK (US) 74126

( * ) Notice: Subject to any disclaimer, the term of this patent is extended or adjusted under 35 U.S.C. 154(b) by 0 days.

(21) Appl. No.: 09/247,979

(22) Filed: Feb. 11, 1999

(51) Int. Cl.[7] ..... F24F 7/00; G05D 23/00
(52) U.S. Cl. ..... 236/49.4; 236/79; 236/84
(58) Field of Search ..... 236/49.4, 79, 86, 236/87, 84

(56) References Cited

U.S. PATENT DOCUMENTS 2,306,557 * 12/1942 Otto ..... 236/49.4 X
5,016,856 * 5/1991 Tartaglino ..... 236/49.4 X

* cited by examiner

*Primary Examiner*—William Wayner

(57) ABSTRACT

A climate control system is provided including a vacuum pump for generating a vacuum upon actuation. Also included is a thermostat for generating the activation signal upon a current temperature within the associated room being out of a predetermined range. At least one vent assembly is provided including a plurality of vanes pivotally mounted within the frame and having an unbiased open orientation for allowing the flow of air into the associated room and a biased closed orientation for precluding the flow of air into the associated room and a pneumatic servo connected to each of the vanes and in communication with the vacuum pump. The servo is adapted to transfer the vanes of the vent assembly to the closed orientation thereof only upon the receipt of vacuum. Finally, a vacuum valve is connected between the vacuum pump and the servo of the vent assembly. Such vacuum valve is connected to the thermostat for supplying the same with a vacuum during the receipt of the activation signal.

7 Claims, 2 Drawing Sheets

FIG.1
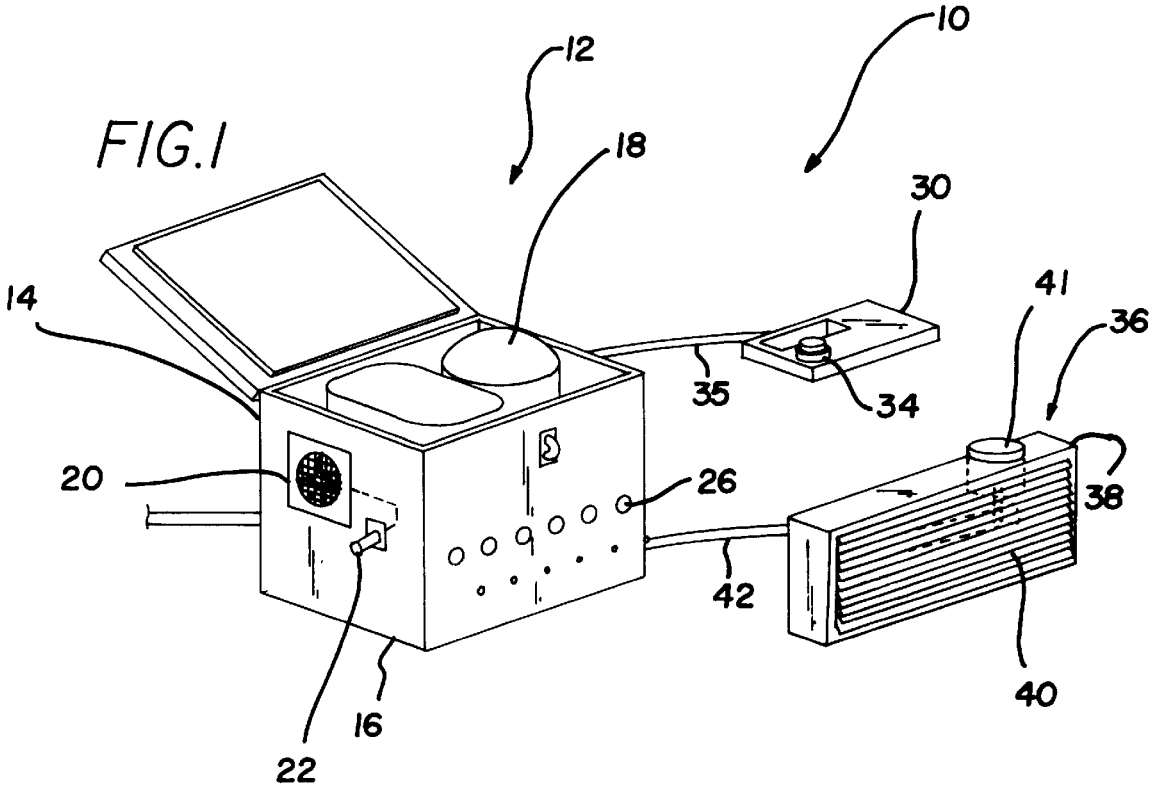
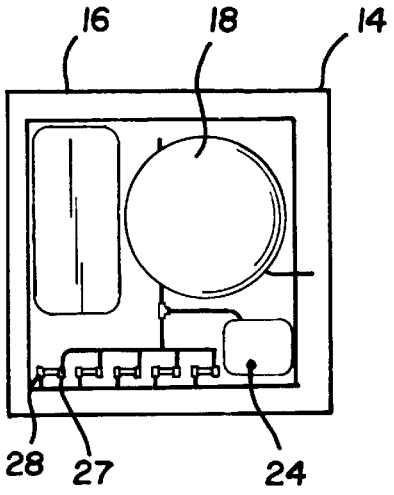
FIG.2

CLIMATE CONTROL DEVICE

BACKGROUND OF THE INVENTION

1. Field of the Invention

The present invention relates to temperature control systems and more particularly pertains to a new climate control device for maintaining a temperature within a room at a constant level.

2. Description of the Prior Art

The use of temperature control systems is known in the prior art. More specifically, temperature control systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,310,111; U.S. Pat. No. 4,957,238; U.S. Pat. No. 4,756,474; U.S. Pat. No. 4,643,353; U.S. Pat. No. 3,346,185; and U.S. Pat. No. 3,653,588.

In these respects, the climate control device according to the present invention substantially departs from the conventional concepts and designs of the prior art, and in so doing provides an apparatus primarily developed for the purpose of maintaining a temperature within a room at a constant level.

SUMMARY OF THE INVENTION

In view of the foregoing disadvantages inherent in the known types of temperature control systems now present in the prior art, the present invention provides a new climate control device construction wherein the same can be utilized for maintaining a temperature within a room at a constant level.

The general purpose of the present invention, which will be described subsequently in greater detail, is to provide a new climate control device apparatus and method which has many of the advantages of the temperature control systems mentioned heretofore and many novel features that result in a new climate control device which is not anticipated, rendered obvious, suggested, or even implied by any of the prior art temperature control systems, either alone or in any combination thereof.

To attain this, the present invention generally comprises a central unit having a housing with a lower portion including a bottom face and a peripheral side wall coupled to a periphery of the bottom face and extending upwardly therefrom. As shown in FIG. 1, an interior space and an open top are thus defined for being selectively covered via a lid with an associated lock for locking purposes. The central unit further includes a vacuum pump mounted within the interior space of the housing. Such vacuum pump is adapted for generating a vacuum upon actuation. Associated therewith is a cooling fan mounted to the side wall of the housing for ventilating the interior space thereof upon actuation. Connected between a power source and the vacuum pump and the cooling fan is an actuation switch. Such switch is positioned on the side wall of the housing for selectively actuating the same. The central unit further includes a plurality of linearly aligned ports mounted on the peripheral side wall of the housing and connected to the vacuum pump. Note FIG. 2. A plurality of normally closed vacuum valves are each connected between one of the ports and the vacuum pump for allowing communication between the vacuum pump and the port only during the receipt of an activation signal. Associated therewith is a plurality of normally open dump valves each connected between one of the ports and the vacuum valve connected thereto. The dump valves serve for allowing communication between the port and free space only during the lack of receipt of the activation signal. Next provided is a plurality of panels each positioned within one of the rooms of the household. Each panel is equipped with a thermostat mounted thereon and is connected to the vacuum pump valve and the dump valve associated with one of the ports. In use, the thermostat generates the activation signal upon a current temperature within the associated room being greater than a predetermined amount. Each of the panels further includes a normally closed vent switch adapted to preclude the transmission of the activation signal to the vacuum pump valve upon the depression thereof. Finally, a plurality of vent assemblies are provided each including a frame mounted within a heating vent in one of the rooms of the household. As shown in FIG. 1, a plurality of vanes are pivotally mounted within the frame and have an unbiased open orientation for allowing the flow of heat into the associated room. The vanes further have a biased closed orientation for precluding the flow of heat into the associated room. A pneumatic servo is connected to each of the vanes and remains in communication with one of the ports of the housing via a conduit. In use, the servo is adapted to transfer the vanes of the vent assembly to the closed orientation thereof only upon the receipt of vacuum via the associated port of the central unit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new climate control device apparatus and method which has many of the advantages of the temperature control systems mentioned heretofore and many novel features that result in a new climate control device which is not anticipated, rendered obvious, suggested, or even implied by any of the prior art temperature control systems, either alone or in any combination thereof.

It is another object of the present invention to provide a new climate control device which may be easily and efficiently manufactured and marketed.

It is a further object of the present invention to provide a new climate control device which is of a durable and reliable construction.

An even further object of the present invention is to provide a new climate control device which is susceptible of a low cost of manufacture with regard to both materials and labor, and which accordingly is then susceptible of low prices of sale to the consuming public, thereby making such climate control device economically available to the buying public.

Still yet another object of the present invention is to provide a new climate control device which provides in the apparatuses and methods of the prior art some of the advantages thereof, while simultaneously overcoming some of the disadvantages normally associated therewith.

Still another object of the present invention is to provide a new climate control device for maintaining a temperature within a room at a constant level.

Even still another object of the present invention is to provide a new climate control device that includes a vacuum pump for generating a vacuum upon actuation. Also included is a thermostat for generating the activation signal upon a current temperature within the associated room being out of a predetermined range. At least one vent assembly is provided including a plurality of vanes pivotally mounted within the frame and having an unbiased open orientation for allowing the flow of air into the associated room and a biased closed orientation for precluding the flow of air into the associated room and a pneumatic servo connected to each of the vanes and in communication with the vacuum pump. The servo is adapted to transfer the vanes of the vent assembly to the closed orientation thereof only upon the receipt of vacuum. Finally, a vacuum valve is connected between the vacuum pump and the servo of the vent assembly. Such vacuum valve is connected to the thermostat for supplying the same with a vacuum during the receipt of the activation signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new climate control device according to the present invention.

FIG. 2 is a top view of the central control unit of the present invention.

DESCRIPTION OF THE PREFERRED EMBODIMENT

Figure 3:
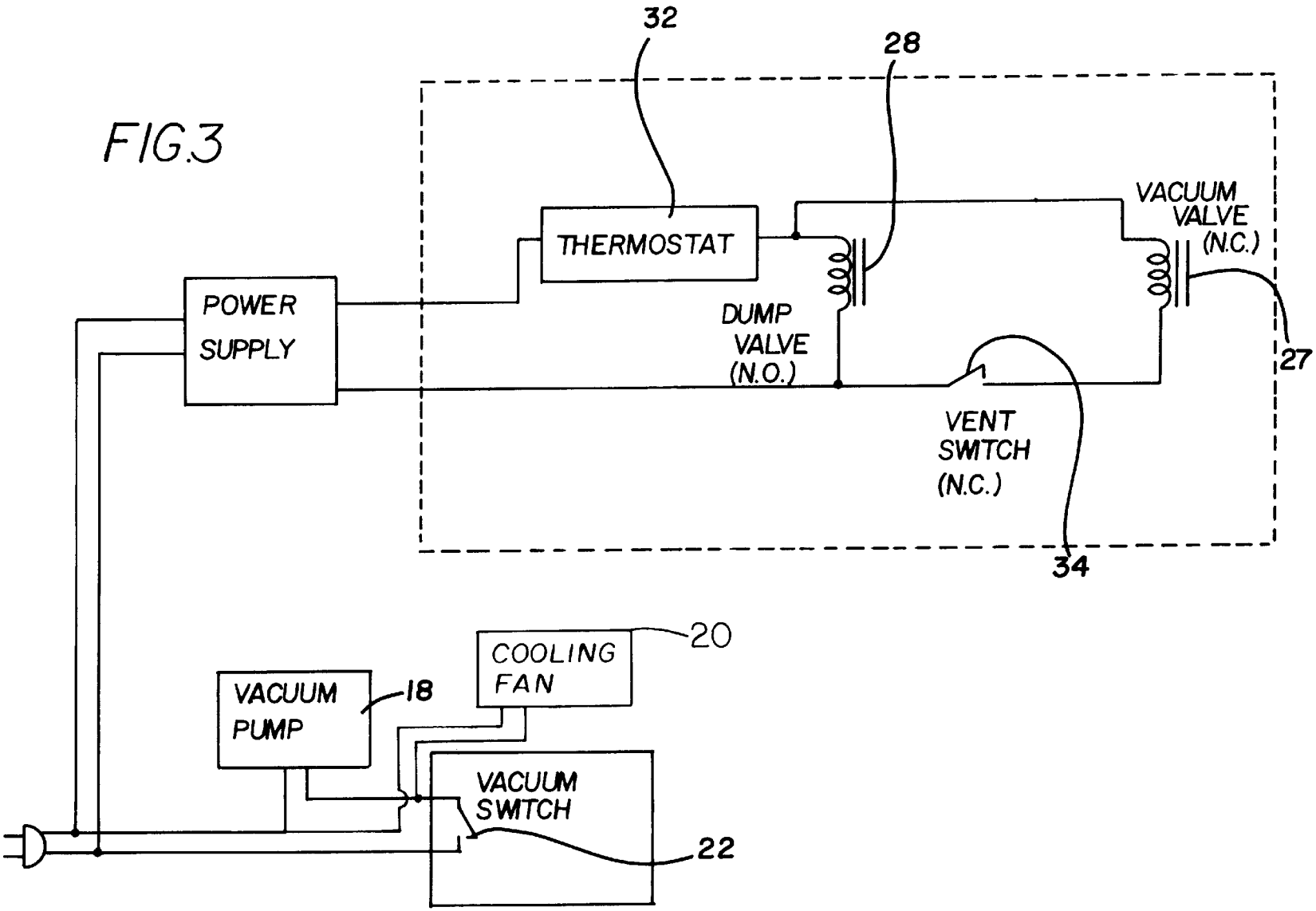
FIG. 3 is a schematic diagram of the present invention.

With reference now to the drawings, and in particular to FIGS. 1 through 3 thereof, a new climate control device embodying the principles and concepts of the present invention and generally designated by the reference numeral 10 will be described.

The present invention, designated as numeral 10, includes a central unit 12 having a housing 14 with a lower portion 16 including a bottom face and a peripheral side wall coupled to a periphery of the bottom face and extending upwardly therefrom. As shown in FIG. 1, an interior space and an open top are thus defined for being selectively covered via a lid with an associated lock for locking purposes. Ideally, the lid is lined with an insulating sheet, as shown in FIG. 1.

The central unit further includes a vacuum pump 18 mounted within the interior space of the housing. Such vacuum pump is adapted for generating a vacuum upon actuation. Associated therewith is a cooling fan 20 mounted to the side wall of the housing for ventilating the interior space thereof upon actuation. Connected between a power source and the vacuum pump and the cooling fan is an actuation switch 22. Such actuation switch is positioned on the side wall of the housing for selectively actuating the vacuum pump and fan. Ideally, in addition to the actuation switch is at least one dial 24 for adjusting a strength of vacuum generated. As will soon become apparent, this feature is critical for adjusting the central unit in order to accommodate various amounts of rooms.

The central unit further includes a plurality of linearly aligned ports 26 mounted on the peripheral side wall of the housing and connected to the vacuum pump via separate conduit branches. Note FIG. 2. A plurality of normally closed vacuum valves 27 are each connected between one of the ports and the vacuum pump for allowing communication between the vacuum pump and the port only during the receipt of an activation signal. Associated therewith is a plurality of normally open dump valves 28 each connected between one of the ports and the associated vacuum valve connected thereto. The dump valves serve for allowing communication between the port and free space only during the lack of receipt of the activation signal.

Next provided is a plurality of panels 30 each positioned within one of the rooms of the household. Each panel is equipped with a thermostat 32 mounted thereon. Such thermostat is connected to the vacuum pump valve and the dump valve associated with one of the ports. In use, the thermostat generates the activation signal upon a current temperature within the associated room being greater than a predetermined amount. Such predetermined amount is preferably selectively determined by way of a dial or the like. In a cooling mode, the thermostat may be adapted to generate the activation signal upon the current temperature within the associated room being less than a predetermined amount.

Each of the panels further includes a normally closed vent switch 34 adapted to preclude the transmission of the activation signal to the vacuum pump valve upon the depression thereof. It should be noted that the thermostat and the vent switch may be connected to the remaining components as shown in FIG. 3 by way of multiple wires within an insulated cable 35. Note FIG. 1. It should be noted that the aforementioned activation signals preferably comprise of a power signal which is afforded by a combination of a battery pack and a 120V electrical receptacle.

Finally, a plurality of vent assemblies 36 are provided each including a frame 38 mounted within a heating or cooling vent in one of the rooms of the household. As shown in FIG. 1, a plurality of vanes 40 are pivotally mounted within the frame and have an unbiased open orientation for allowing the flow of heat into the associated room. The vanes further have a biased closed orientation for precluding the flow of heat into the associated room. This may be accomplished by having a single spring loaded rod pivotally coupled to each of the vanes for urging the same to the open orientation simultaneously. A pneumatic servo 41 is connected to each of the vanes by way of the rod and remains in communication with one of the ports of the housing via a conduit 42.

In use, the servo is adapted to transfer the vanes of the vent assembly to the closed orientation thereof only upon the receipt of vacuum via the associated port of the central unit. As such, when a temperature within the room surpasses the predetermined amount, the activation signal is generated which in turn opens the associated vacuum valve, closes the associated dump valve, and closes the vent assembly, thereby precluding heat from flowing into the room.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A climate control system adapted for use in a household having a plurality of rooms, the system comprising, in combination:

a central unit including a housing with a lower portion having a bottom face and a peripheral side wall coupled to a periphery of the bottom face and extending upwardly therefrom for defining an interior space and an open top for being selectively covered via a lid with an associated lock for locking purposes, the central unit further including a vacuum pump mounted within the interior space of the housing for generating a vacuum upon actuation, a cooling fan mounted to the side wall of the housing for ventilating the inferior space thereof upon actuation, an actuation switch connected between a power source and the vacuum pump and the cooling fan and extending from the side wall of the housing for selectively actuating the same, a plurality of linearly aligned ports mounted on the peripheral side wall of the housing and connected to the vacuum pump, a plurality of normally closed vacuum valves each connected between one of the ports and the vacuum pump for allowing communication between the vacuum pump and the port only during the receipt of an activation signal, and a plurality of normally open dump valves each connected between one of the ports and the vacuum valve connected thereto for allowing communication between the port and free space only during the lack of receipt of the activation signal;

at least one panel being equipped with a thermostat mounted thereon and connected to the vacuum pump valve and the dump valve associated with one of the ports, the thermostat adapted for generating the activation signal upon a current temperature within an area being greater than a predetermined amount, each panel further includes a normally closed vent switch adapted to preclude the transmission of the activation signal to the vacuum pump valve upon the depression thereof;

at least one vent assembly each including a frame adapted for mounting within a heating vent in one of the rooms of the household, a plurality of vanes pivotally mounted within the frame and having an unbiased open orientation for allowing the flow of heat into the associated room and a biased closed orientation for precluding the flow of heat into the associated room, and a pneumatic servo connected to each of the vanes and in communication with one of the ports of the housing via a conduit, the servo adapted to transfer the vanes of the vent assembly to the closed orientation thereof only upon the receipt of vacuum via the associated port of the central unit.

2. A climate control system for controlling a climate within a room of a household comprising:

a vacuum pump for generating a vacuum upon actuation by an actuation switch;

a thermostat for generating an activation signal upon a current temperature within the room being out of a predetermined range;

at least one vent assembly including a plurality of vanes having an unbiased open orientation adapted for allowing the flow of air into the associated room and a biased closed orientation adapted for precluding the flow of air into the associated room and a pneumatic servo connected to each of the vanes and in communication with the vacuum pump, the servo is adapted to transfer the vanes of the vent assembly to the closed orientation thereof only upon the receipt of a vacuum; and a vacuum valve connected between the vacuum pump and the servo of the vent assembly and further connected to the thermostat for supplying the same with a vacuum during the receipt of the activation signal.

3. A climate control system as set forth in claim 2 and further including a switch for selectively precluding the transmission of the activation signal to the valve upon the closing thereof.

4. A climate control system as set forth in claim 2 wherein a dump valve is positioned between the vacuum valve and the servo and connected to the thermostat for releasing the vacuum upon the lack of receipt of the activation signal.

5. A climate control system as set forth in claim 2 wherein the vacuum pump is positioned within a housing having a cooling fan that actuates during the actuation of the vacuum pump.

6. A climate control system as set forth in claim 2 wherein a plurality of vent assemblies are connected to the vacuum pump with one of a plurality of valves positioned therebetween each with a thermostat coupled thereto.

7. A climate control system adapted for use in a household having a plurality of rooms, the system comprising, in combination:

a central unit including a housing with a lower portion having a bottom face and a peripheral side wall coupled to a periphery of the bottom face and extending upwardly therefrom for defining an interior space, the central unit further including a vacuum pump mounted within the interior space of the housing for generating a vacuum upon actuation, a cooling fan mounted to the side wall of the housing for ventilating the interior space thereof upon actuation, an actuation switch connected between a power source and the vacuum pump and the cooling fan and extending from the side wall of the housing for selectively actuating the vacuum pump and the cooling fan, a plurality of linearly aligned ports mounted on the peripheral side wall of the housing and connected to the vacuum pump, a plurality of normally closed vacuum valves each connected between one of the ports and the vacuum pump for allowing communication between the vacuum pump and the port only during the receipt of an activation signal, and a plurality of normally open dump valves each connected between one of the ports and the vacuum valve connected thereto for allowing communication between the port and free space only during the lack of receipt of the activation signal;

a panel being equipped with a thermostat mounted thereon and connected to the vacuum pump valve and the dump valve associated with one of the ports, the thermostat adapted for generating the activation signal upon a current temperature within an area being greater than a predetermined amount, the panel further including a normally closed vent switch adapted to preclude the transmission of the activation signal to the vacuum pump valve upon the depression thereof; and a vent assembly adapted for mounting within a heating vent in one of the rooms of the household, the vent assembly having a plurality of vanes having an unbiased open orientation for allowing the flow of heat into the associated room and a biased closed orientation for precluding the flow of heat into the associated room, and a servo connected to each of the vanes and in communication with one of the ports of the housing via a conduit, the servo is adapted to transfer the vanes of the vent assembly to the closed orientation thereof only upon the receipt of vacuum via the associated port of the central unit.

* * * * *